US005166024A

United States Patent [19]

Bugner et al.

[11] Patent Number: 5,166,024

[45] Date of Patent: Nov. 24, 1992

[54] PHOTOELECTROGRAPHIC IMAGING WITH NEAR-INFRARED SENSITIZING PIGMENTS

[75] Inventors: Douglas E. Bugner; William Mey; G. Gary Fulmer, all of Rochester, N.Y.

[73] Assignee: Eastman Kodak Company, Rochester, N.Y.

[21] Appl. No.: 632,258

[22] Filed: Dec. 21, 1990

[51] Int. Cl.[5] ..... G03G 5/06

[52] U.S. Cl. ..... 430/70; 430/280; 430/56

[58] Field of Search ..... 430/280, 58, 70, 56, 430/78

[56] References Cited

U.S. PATENT DOCUMENTS

| | | | |
|---|---|---|---|
| 3,316,088 | 4/1967 | Schaffert | 96/1.5 |
| 3,525,612 | 8/1970 | Holstead | 96/1 |
| 3,681,066 | 8/1972 | McGuckin | 96/1 R |
| 4,501,808 | 2/1985 | Sakai et al. | 430/59 |
| 4,650,734 | 3/1987 | Molaire et al. | 430/7 |
| 4,661,429 | 4/1987 | Molaire et al. | 430/70 |
| 4,680,244 | 7/1987 | Lehmann et al. | 430/66 |
| 4,708,925 | 11/1987 | Newman | 430/270 |
| 4,882,254 | 11/1989 | Loutfy et al. | 430/59 |

*Primary Examiner*—Marion E. McCamish
*Assistant Examiner*—S. Rosasco
*Attorney, Agent, or Firm*—Michael L. Goldman; Willard G. Montgomery; Alfred P. Lorenzo

[57] ABSTRACT

The present invention relates to a photoelectrographic element having a conductive layer in electrical contact with an acid photogenerating layer which is free of photopolymerizable materials and contains an electrically insulating binder and acid photogenerator. A pigment which absorbs near-infrared radiation is included in the photoelectrographic element so that the element, when used in electrostatic copying, can be exposed with near-infrared radiation. A method for forming images with this element is also disclosed.

16 Claims, No Drawings

PHOTOELECTROGRAPHIC IMAGING WITH NEAR-INFRARED SENSITIZING PIGMENTS

FIELD OF THE INVENTION

This invention relates to new photoelectrographic elements and an imaging method of exposing such elements with near-infrared radiation.

BACKGROUND OF THE INVENTION

Acid photogenerators are known for use in photoresist imaging elements. In imaging processes utilizing such elements, the acid photogenerator is coated on a support and imagewise exposed to actinic radiation. The layer containing the acid photogenerator is then contacted with a photopolymerizable or curable composition such as epoxy and epoxy-containing resins. In the exposed areas, the acid photogenerator generates protons which catalyze polymerization or curing of the photopolymerizable composition. Acid photogenerators are disclosed, for example, in U.S. Pat. Nos. 4,081,276, 4,058,401, 4,026,705, 2,807,648, 4,069,055, and 4,529,490.

Acid photogenerators have been employed in photoelectrographic elements to be exposed with actinic or undefined radiation as shown, for example, in U.S. Pat. No. 3,316,088. Photoelectrographic elements have been found useful where multiple copies from a single exposure are desired. See e.g., U.S. Pat. Nos. 4,661,429 and 3,681,066 as well as German Democratic Republic Patent No. 226,067 and Japanese Patent No. 105,260. Sensitizer dyes have been disclosed with regard to such elements, but not for sensitization in the near-IR portion of the spectrum. See, for example, in U.S. Pat. No. 3,525,612 and Japanese Patent No. 280,793.

SUMMARY OF THE INVENTION

The present invention relates to a photoelectrographic element comprising a conductive layer in electrical contact with an acid photogenerating layer. The acid photogenerating layer is free of photopolymerizable materials and includes an electrically insulating binder and an acid photogenerator in accordance with U.S. Pat. No. 4,661,429. The present invention constitutes an improvement over U.S. Pat. No. 4,661,429 by incorporating a pigment in the photoelectrographic element which absorbs near-infrared radiation. As a result, the element can be sensitized with such radiation.

The present invention also provides a photoelectrographic imaging method which utilizes the above-described photoelectrographic element. This process comprises the steps of: exposing the acid photogenerating layer imagewise to near-infrared radiation without prior charging to create a latent conductivity pattern and printing by a sequence comprising: charging to create an electrostatic latent image, developing the electrostatic latent image with charged toner particles, transferring the toned image to a suitable receiver, and cleaning any residual, untransferred toner from the photoelectrographic element.

The imaging method and elements of the present invention use acid photogenerators in thin layers coated over a conductive layer to form images. This imaging technique or method takes advantage of the discovery that exposure of the acid generator significantly increases the conductivity in the exposed area of the layer. Imagewise radiation of the acid photogenerator layer creates a persistent differential conductivity between exposed and unexposed areas. This allows for the subsequent use of the element for printing multiple copies from a single exposure with only multiple charging, developing, transferring, and cleaning steps. This is different from electrophotographic imaging techniques where the electrophotographic element must generally be charged electrostatically followed by imagewise exposure for each copy produced. As a result, maximum throughput tends to be limited, and energy consumption is likely to be greater.

The charged toner may have the same sign as the electrographic latent image or the opposite sign. In the former case, a negative image is developed, while a positive image is developed in the latter.

By incorporating a pigment which absorbs near-infrared radiation in the photoelectrographic element containing an acid generating layer, such elements are no longer limited to exposure with ultraviolet and visible radiation. Such pigments instead permit exposure with radiation in the near-infrared region of the spectrum (having wavelengths of 650 to 1,000 nm). Nevertheless, these pigments also have the ability to absorb near-ultraviolet radiation, thereby permitting exposure with a conventional U.V. radiation source or with a laser diode which emits radiation in the near-infrared part of the spectrum. The use of laser diodes is particularly advantageous, because they are relatively inexpensive and consume little energy. Pigments absorbing near-infrared radiation can be included in the same layer as the acid photogenerating compound or as a separate layer adjacent to the acid photogenerating layer. Certain copper (II) salts, which are known to catalyze the thermal decomposition of iodonium salts especially when used in conjunction with compounds containing secondary hydroxyl groups, may also be included in the acid photogenerating layer.

DETAILED DESCRIPTION OF THE INVENTION

As already noted, the present invention relates to a photoelectrographic element comprising a conductive layer in electrical contact with an acid photogenerating layer which is free of photopolymerizable materials and includes an electrically insulating binder and an acid photogenerator. In this element, the improvement resides in the use of a pigment which absorbs near-infrared radiation so that the element can be exposed with such radiation during electrostatic imaging or printing processes.

In preparing acid photogenerating layers, the acid photogenerator and an electrically insulating binder are dissolved in a suitable solvent. To the resulting solution, a dispersion of pigment in the same or different solvent is added.

Solvents of choice for preparing acid photogenerator coatings include a number of solvents including aromatic hydrocarbons such as toluene; ketones, such as acetone or 2-butanone; esters, such as ethyl acetate or methyl acetate chlorinated hydrocarbons such as ethylene dichloride, trichloroethane, and dichloromethane, ethers such as tetrahydrofuran; or mixtures of these solvents.

The acid photogenerating layers are coated on a conducting support in any well-known manner such as by doctor-blade coating, swirling, dip-coating, and the like.

The acid photogenerating materials should be selected to impart little or no conductivity before irradiation with the conductivity level increasing after exposure. Useful results are obtained when the coated layer contains at least about 1 weight percent of the acid photogenerator The upper limit of acid photogenerator is not critical as long as no deleterious effect on the initial conductivity of the film is encountered. A preferred weight range for the acid photogenerator in the coated and dried composition is from 15 weight percent to about 30 weight percent.

The thicknesses of the acid photogenerator layer can vary widely with dry coating thicknesses ranging from about 0.1 μm to about 50 μm. Coating thicknesses outside these ranges may also be useful.

Although there are many known acid photogenerators useful with ultraviolet and visible radiation, the utility of their exposure with near-infrared radiation is unpredictable. Potentially useful aromatic onium salt acid photogenerators are disclosed in U.S. Pat. Nos. 4,661,429, 4,081,276, 4,529,490, 4,216,288, 4,058,401, 4,069,055, 3,981,897, and 2,807,648 which are hereby incorporated by reference. Such aromatic onium salts include Group Va, Group VIa, and Group VIIa elements. The ability of triarylselenonium salts, aryldiazonium salts, and triarylsulfonium salts to produce protons upon exposure to ultraviolet and visible light is also described in detail in "UV Curing, Science and Technology", Technology Marketing Corporation, Publishing Division, 1978.

A representative portion of useful Group Va onium salts are:

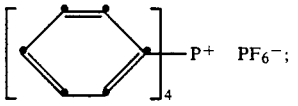

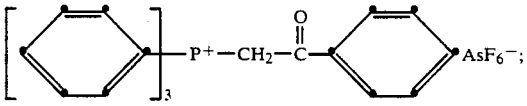

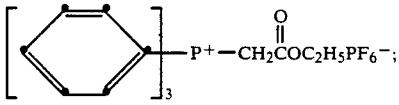

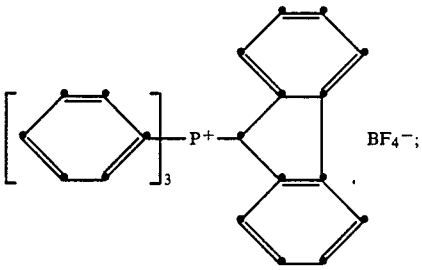

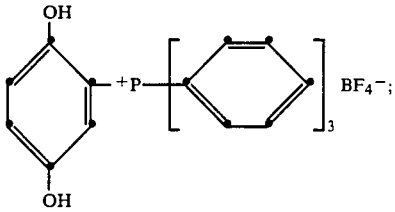

-continued

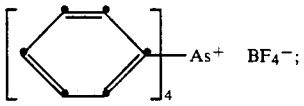

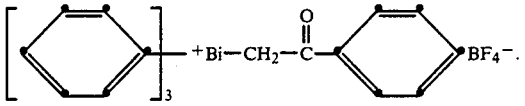

A representative portion of useful Group VIa onium salts, including sulfonium and selenonium salts, are:

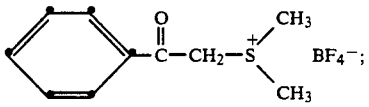

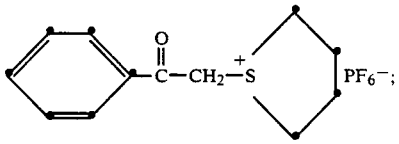

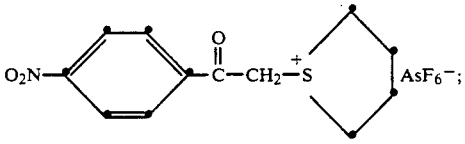

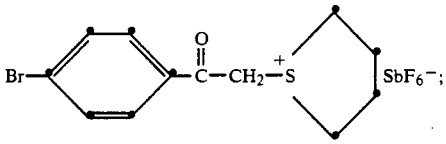

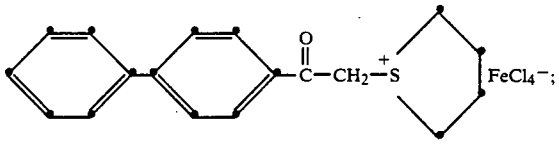

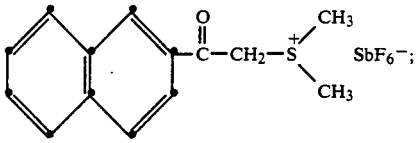

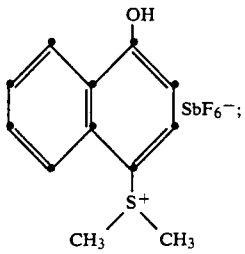

-continued
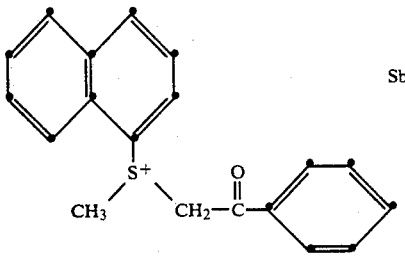
$SbF_6^-$;
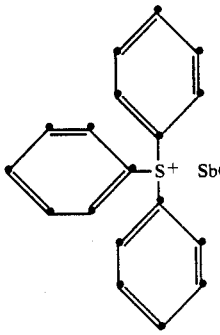
$SbCl_4^-$;
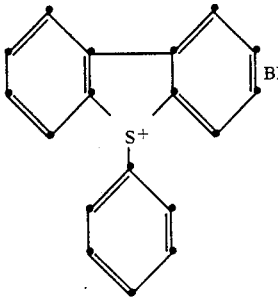
$BF_4^-$;
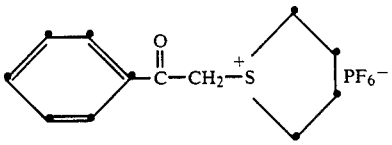
$PF_6^-$
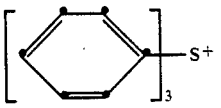
$BF_4^-$;
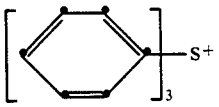
$PF_6^-$;
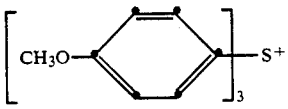
$AsF_6^-$; and
-continued
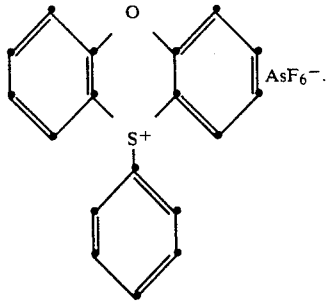
$AsF_6^-$.
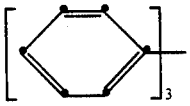
$BF_4^-$;
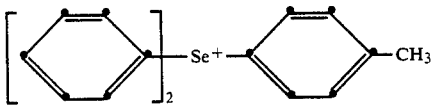
$SbF_6^-$; and
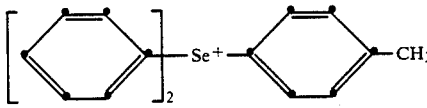
$AsF_6^-$.
A representative portion of the useful Group VIIa onium salts, including iodonium salts, are the following:
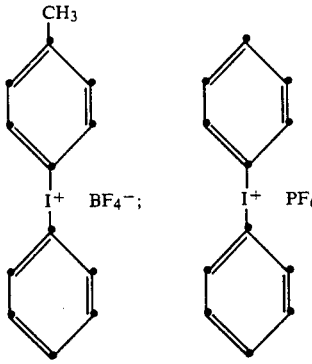
$BF_4^-$;
$PF_6^-$;
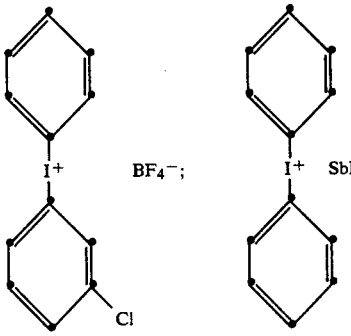
$BF_4^-$;
$SbF_6^-$;

-continued

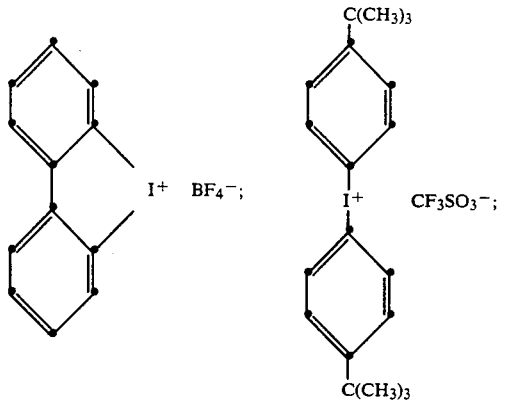

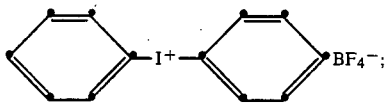

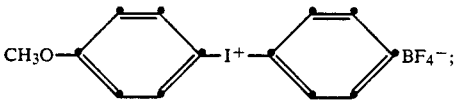

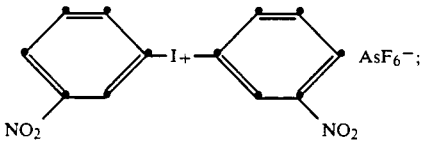

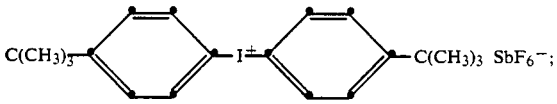

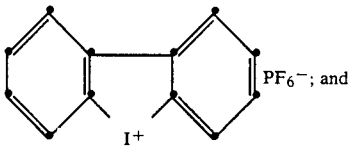

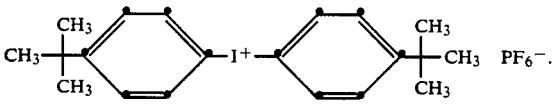

Also useful as acid photogenerating compounds are:

1. Aryldiazonium salts such as disclosed in U.S. Pat. Nos. 3,205,157; 3,711,396; 3,816,281; 3,817,840 and 3,829,369. The following salts are representative:

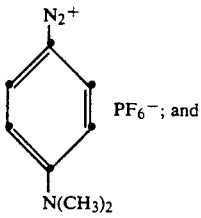

-continued

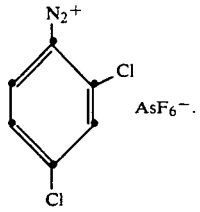

2. 6-Substituted-2,4-bis(trichloromethyl)-5-triazines such as disclosed in British Patent No. 1,388,492. The following compounds are representative:

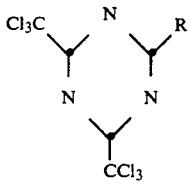

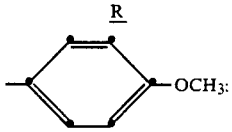

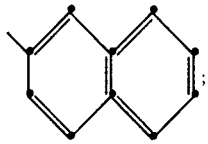

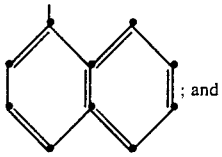

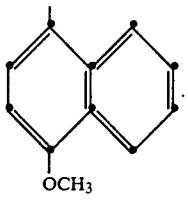

A particularly preferred class of acid photogenerators are the diaryl iodonium salts, especially di-(4-t-butylphenyl)iodonium trifluoromethanesulfonate ("ITF").

Useful electrically insulating binders for the acid photogenerating layers include polycarbonates, polyesters, polyolefins, phenolic resins, and the like. Desirably, the binders are film forming. Such polymers should be capable of supporting an electric field in excess of $1\times10^5$ V/cm and exhibit a low dark decay of electrical charge.

Preferred binders are styrene-butadiene copolymers; silicone resins; styrene-alkyd resins; soya-alkyd resins; poly(vinyl chloride); poly(vinylidene chloride); vinylidene chloride, acrylonitrile copolymers; poly(vinyl acetate); vinyl acetate, vinyl chloride copolymers;

poly(vinyl acetyls), such as poly(vinyl butyral); polyacrylic and methacrylic esters, such as poly(methyl methacrylate), poly(n-butyl methacrylate), poly(isobutyl methacrylate), etc; polystyrene; nitrated polystyrene; poly(vinylphenol)polymethylstyrene; isobutylene polymers; polyesters, such as phenol formaldehyde resins; ketone resins; polyamides; polycarbonates; etc. Methods of making resins of this type have been described in the prior art, for example, styrene-alkyd resins can be prepared according to the method described in U.S. Pat. Nos. 2,361,019 and 2,258,423. Suitable resins of the type contemplated for use in the photoactive layers of this invention are sold under such tradenames as Vitel PE 101-X, Cymac, Piccopale 100, Saran F-220. Other types of binders which can be used include such materials as paraffin, mineral waxes, etc. Particularly preferred binders are aromatic esters of polyvinyl alcohol polymers and copolymers, as disclosed in pending U.S. patent application Ser. No. 509,119, entitled "Photoelectrographic Elements". One example of such a polymer is poly (vinyl benzoate-co-vinyl acetate) ("PVBZ").

The binder is present in the element in a concentration of 30 to 98 weight %, preferably 55 to 80 weight %.

Useful conducting layers include any of the electrically conducting layers and supports used in electrophotography. These include, for example, paper (at a relative humidity above about 20 percent); aluminum paper laminates; metal foils, such as aluminum foil, zinc foil, etc.; metal plates, such as aluminum, copper, zinc, brass, and galvanized plates; regenerated cellulose and cellulose derivatives; certain polyesters, especially polyesters having a thin electroconductive layer (e.g., cuprous iodide) coated thereon; etc.

While the acid photogenerating layers of the present invention can be affixed, if desired, directly to a conducting substrate or support, it may be desirable to use one or more intermediate subbing layers between the conducting layer or substrate and the acid photogenerating layer to improve adhesion to the conducting substrate and/or to act as an electrical and/or chemical barrier between the acid photogenerating layer and the conducting layer or substrate.

Such subbing layers, if used, typically have a dry thickness in the range of about 0.1 to about 5 $\mu$m. Useful subbing layer materials include film-forming polymers such as cellulose nitrate, polyesters, copolymers or poly(vinyl pyrrolidone) and vinylacetate, and various vinylidene chloride-containing polymers including two, three and four component polymers prepared from a polymerizable blend of monomers or prepolymers containing at least 60 percent by weight of vinylidene chloride. Other useful subbing materials include the so-called tergals which are described in Nadeau et al, U.S. Pat. No. 3,501,301.

Optional overcoat layers are useful with the present invention, if desired. For example, to improve surface hardness and resistance to abrasion, the surface layer of the photoelectrographic element of the invention may be coated with one or more organic polymer coatings or inorganic coatings. A number of such coatings are well known in the art and accordingly an extended discussion thereof is unnecessary. Several such overcoats are described, for example, in *Research Disclosure*, "Electrophotographic Elements, Materials, and Processes", Vol. 109, page 63, Paragraph V, May, 1973, which is incorporated herein by reference.

The pigment which absorbs near-infrared radiation can be any such material possessing this property but must not adversely interfere with the operation of the acid photogenerating layer.

Suitable pigments include those selected from the phthalocyanine pigment family. Particularly useful phthalocyanine pigments include:

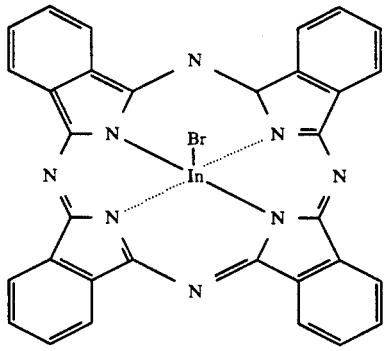

bromoindium phgthalocyanine ("BrInPc")

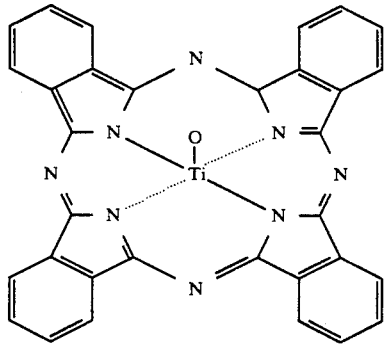

titanyl phthalocyanine ("TiOPc")

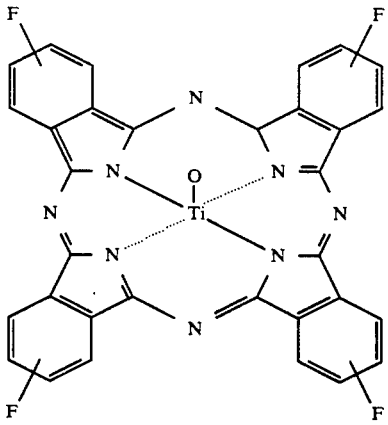

tetrafluoro-phthalocyanine ("TiOPcF4")

Use of these pigments in photoelectrographic elements is particularly advantageous, because they not only absorb near-infrared radiation (i.e. 600 to 900 nm) which can be produced by laser diodes, but also near-ultraviolet radiation (i.e. 250 to 450 nm) produced by conventional sources of exposure. As a result, these photoelectrographic elements have great flexibility. Typically, near-infrared radiation absorptive pigments are included in the photoelectrographic element of the present invention at concentrations 1 to 20 weight %, preferably 5 to 15 weight %, of the element.

When the acid generating layer contains iodonium salts, it may be advantageous to include in that layer a compound with secondary hydroxyl groups and a copper (II) salt which, when used together, are known to catalyze thermal decomposition of iodonium salts. Suitable copper (II) salts are disclosed by J. V. Crivello, T. P. Lockhart, and J. L. Lee, *J. Polym. Sci., Polym. Chem. Ed.*, 21, 97 (1983). These include copper (II) arylates, copper (II) alkanoates, copper (II) acetonates, copper (II) acetoacetates, and mixtures thereof.

A particularly preferred example of a copper (II) salt useful for this invention is copper (II) ethyl acetoacetate. This salt is soluble in organic solvents such as dichloromethane and can be homogeneously incorporated at concentrations as high as 18% by weight of the dry photoelectrographic element.

The compound with secondary hydroxyl groups include those which contain dialkyl-, diaryl-, alkylaryl-, and hydroxymethane moieties. A particularly preferred compound with secondary hydroxyl groups is the binder polymer having the following formula:

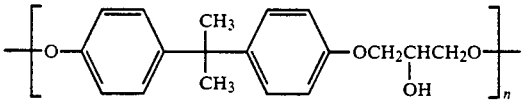

This is a copolymer of bisphenol A and epichlorohydrin, and may be obtained from Aldrich Chemical Company, Milwaukee, Wis. under the trade name PHENOXY RESIN.

The pigment can either be included in the acid photogenerating layer or in an adjacent separate layer.

When the pigment is incorporated in the acid photogenerating layer, the acid generating layer contains 0.1 to 30, preferably 1–15, weight percent of pigment. If a copper (II) salt and a compound with secondary hydroxyl groups are included in this layer, the copper (II) salt is present in an amount of 1 to 20, preferably 10–15, weight percent and, except when PHENOXY RESIN is used, the compound with secondary hydroxyl groups is present in an amount of 1 to 10, preferably 2–4, weight percent. When PHENOXY RESIN is used as the compound with secondary hydroxyl groups, it is also functioning as the binder and then is used, in a concentration of 30–98 weight %, preferably 55 to 80 weight %. The thickness of the acid generating layer ranges from 1 to 30 μm, preferably 5 to 10 μm.

If the pigment is utilized as a separate layer, that layer is positioned adjacent to the acid photogenerating layer, preferably between the conductive layer and the acid Photogenerating layer. Preferably, the pigment-containing layer has a thickness of 0.05 to 5, preferably .5 to 2.0, μm.

The photoelectrographic elements of the present invention are employed in the photoelectrographic process summarized above. This process involves a 2-step sequence—i.e. an exposing phase followed by a printing phase.

In this exposing phase, the acid photogenerating layer is exposed imagewise to near-infrared radiation without prior charging to create a latent conductivity pattern. Once the exposing phase is completed, a persistent latent conductivity pattern exists on the element, and no further exposure is needed. The element can then be subjected to the printing phase either immediately or after some period of time has passed.

The element is given a blanket electrostatic charge, for example, by passing it under a corona discharge device, which uniformly charges the surface of the acid photogenerator layer. The charge is dissipated by the layer in the exposed areas, creating an electrostatic latent image. The electrostatic latent image is developed with charged toner particles, and the toned image is transferred to a suitable receiver (e.g., paper). The toner particles can be fused either to a material (e.g., paper) on which prints are actually made or to an element to create an optical master or a transparency for overhead projection. Any residual, untransferred toner is then cleaned away from the photoelectrographic element.

The toner particles are in the form of a dust, a powder, a pigment in a resinous carrier, or a liquid developer in which the toner particles are carried in an electrically insulating liquid carrier. Methods of such development are widely known and described as, for example, in U.S. Pat. Nos. 2,296,691, 3,893,935, 4,076,857, and 4,546,060.

By the above-described process, multiple prints from a single exposure can be prepared by subjecting the photoelectrographic element only once to the exposing phase and then subjecting the element to the printing phase once for each print made.

The photoelectrographic layer can be developed with a charged toner having the same polarity as the latent electrostatic image or with a charged toner having a different polarity from the latent electrostatic image. In one case, a positive image is formed. In the other case, a negative image is formed. Alternatively, the photoelectrographic layer can be charged either positively or negatively and the resulting electrostatic latent images can be developed with a toner of given polarity to yield either a positively or negatively appearing image.

Once the permanent latent conductivity pattern on the photoelectrographic element is no longer needed for making prints, this pattern can be erased by heating to a temperature of 110° to 130° C., preferably 120° C., for several seconds. The element is then available for reuse as a master for printing a different image according to the above-described process.

The photoelectrographic element of the present invention can be imaged with a laser, which emits radiation most efficiently at near-infrared wavelengths. For example, a laser diode with about 200 mW peak power output at 827 nm and a spot size of about 30 μm can be used to image the photoelectrographic element. In a typical device, the element is mounted on a rotating drum, and the laser is stepped across the length of the drum in lines about 20 μm from center to center. The image is written by modulating the output of the laser in an imagewise manner. When photoelectrographic elements of the present invention are imaged in this manner, an imagewise conductivity pattern is formed from which toned images can be produced, as described above.

In an alternate embodiment, the photoelectrographic element of the present invention can also be used as an electrophotographic element, as described above in the Summary of the Invention section. This has the added advantage of permitting differential annotation of each image produced during the printing phase. For example, address information can be varied from one print to the next.

EXAMPLES

In the examples which follow, the preparation of representative materials, the formulation of representative film packages, and the characterization of these films are described. These examples are provided to illustrate the usefulness of the photoelectrographic element of the present invention and are by no means intended to exclude the use of other elements which fall within the above disclosure.

The coatings described below were all prepared by either hand coating or machine coating techniques. In either case, the support comprises a flexible polyester base which is overcoated with (a) cuprous iodide (3.4 wt%) and poly(vinyl formal) (0.32 wt%) in acetonitrile (96.3 wt%), and (b) cellulose nitrate (6 wt%) in 2-butanone (94 wt%) over (a). Hand coatings were carried out by drawing the experimental coating solutions over the support with a doctor blade such that the thickness of the dried films were between 5 and 10 microns. Machine coatings were performed by pumping the coating solutions through an extrusion hopper (5 mil slot width) onto the moving support (20 ft/min). Dried film thicknesses between 5 and 10 microns were achieved by adjusting the pump speed.

The sensitivity of the coatings to near-IR exposure was evaluated in the following manner. The film was exposed on a breadboard equipped with a 200 mW IR laser diode (827 nm output), and the output beam focused to a 30 μm spot. The breadboard consists of a rotating drum, upon which the film is mounted, and a translation stage which moves the laser beam along the drum length. The drum rotation, the laser beam location, and the laser beam intensity are all controlled by an IBM-AT computer. The drum was rotated at a speed of 120 rpm, and the film was exposed to an electronically generated graduated exposure consisting of 11 exposure steps. The line spacing (distance between scan lines in the continuous tone step-wedge) was 20 μm, and the maximum intensity was about 100 mW with an exposure time of about 30 μsec/pixel. Within one-half hour after exposure, the sample was mounted and tested on a separate linear breadboard. The sample was corona charged with a grid controlled charger set at a grid potential of +500 V. The surface potential was then measured at 1 sec after charging.

The near-UV sensitivity was measured by the following procedure. Each film sample was evaluated by mounting it in electrical contact with a metal drum, and rotating the drum past a corona charger and an electrostatic voltmeter. The configuration is such that a given area of the film passes in front of the charger and voltmeter once every second, with the time between the charger and voltmeter being about 200 milliseconds. The grid potential on the charger is set at +700 volts, with 0.40 ma current. The voltmeter measures the surface potential on both the exposed and unexposed regions of the film each cycle After several cycles, both exposed and unexposed regions of the film reach equilibrium potentials.

When measuring either IR or UV sensitivity, the potential in an unexposed region is termed $V_{max}$ and the potential in a maximally exposed region is termed $V_{min}$. The difference between $V_{max}$ and $V_{min}$ is called δ V, and represents the potential available for development. Since $V_{max}$ varies with relative humidity ("RH"), film thickness, and specific formulation and since δ V is a function of $V_{max}$, it is difficult to compare δ V s by themselves from one measurement to the next. However, we have found that the degree of discharge (hereafter "Fm"), i.e., the ratio of δ V to $V_{max}$, is independent of $V_{max}$ and is in the range of 400 to 800 volts. Therefore, for the Purpose of comparing the photoelectrographic behavior of the various inventive formulations, the values of $V_{max}$ and Fm will be used. Ideally, Fm should not change in response to changes in RH, but should remain constant.

Conventional photoconductivity measurements were performed on samples which had been charged to ca. (i.e. about) +500 V with a corona discharge device. Low intensity light (i.e. ca. 5 erg/cm$^2$-sec) which had been passed through a monochromator set at 830 nm was used to discharge the film. The film speed is given as the amount of light energy per unit area required to discharge the film to 80% of the initial voltage, Vo.

EXAMPLE 1

A solution comprising 3.75 wt% ITF, 1.5 wt% TiOPcF$_4$, and 9.75 wt% PVBZ in 85 wt% dichloromethane ("DCM") was hand-coated using a 6 mil blade. The coating was allowed to dry overnight under ambient conditions. Preliminary evaluation of the film revealed the photoactive layer to be 9.2 μm thick and the optical density to be 1.80 at 825 nm. When the film was exposed to near-infrared radiation, as described above, the results set forth in Table 1 were achieved using various drum speeds.

TABLE 1

| Drum Speed | Vmax | Fm |
|---|---|---|
| 120 rpm | +540V | 0.79 |
| 360 rpm | +463V | 0.79 |
| 600 rpm | +464V | 0.37 |

When the sample exposed by near-IR radiation at a drum speed of 120 rpm was further evaluated at 1, 5, and 8 days after the original exposure, the results set forth in Table 2 were achieved.

TABLE 2

| Day | Vmax | Fm |
|---|---|---|
| 2 | +552V | 0.76 |
| 6 | +564V | 0.73 |
| 9 | +476V | 0.82 |

EXAMPLE 2

A mixture comprising 3.22 wt% ITF, 1.29 wt% BrInPc, and 8.39 wt% PVBZ in 87.1 wt% DCM was machine-coated under the general conditions described above. The drying conditions were adjusted such that the film was gradually warmed to 160° F., held at that temperature briefly, then cooled down to room temperature. This film was found to possess a photoactive layer 9.8 μm thick and which displays an optical density of 1.50 at 825 nm.

When the film was exposed to near-infrared radiation, as described above, the results set forth in Table 3 were achieved using various drum speeds.

TABLE 3

| Drum Speed | Vmax | Fm |
|---|---|---|
| 120 | +581V | 0.79 |

TABLE 3-continued

| Drum Speed | Vmax | Fm |
|---|---|---|
| 240 | +582V | 0.78 |
| 360 | +554V | 0.73 |

When the sample exposed to near-IR radiation at 120 rpm was re-evaluated one day later, it had a Vmax of +582 V and an Fm of 0.76.

Another sample of this film was exposed with near-IR radiation at a drum speed of 300 rpm. The section of the step-wedge receiving the highest exposure exhibited a charge acceptance of only +192 V at 1 sec past the charger, while an unexposed area of the same sample was charged to +460 V (Fm=0.58). This sample was heated to 120° C. for 10 sec, and then recharged. The potential measured across the same area of the step-wedge showed a constant value of +451 V which demonstrates that the electrostatic latent image had been erased. The film was then re-exposed exactly as before. The step receiving maximum exposure was charged to +197 V, whereas the unexposed area of the film was charged to +460 V.

Another sample of this film was exposed to near-IR radiation in the same manner as before. The film was then mounted on a high-speed breadboard and electrically cycled 500 times. The film was charged with a roller charger biased to +2 kV, and the surface potential was monitored 0.14 sec after the charger. After 500 cycles, $V_{max}$ and Fm were about 300 V and 0.7, respectively.

Yet another sample of this film was evaluated for conventional photoconductivity with near-infrared radiation. The sample was charged to +500 V, allowed to dark decay to +475 V, and then was irradiated at 830 nm (5 erg/cm$^2$-sec). The dark decay was 16 V/s, the energy required to discharge to +95 V (80% discharge) was 30 erg/cm$^2$, and the residual voltage on the film was +40 V.

This example shows that a film of the present invention displays high Fm's with either near-IR or near-UV exposures, can be run for hundreds of cycles at high speed, has a stable memory, can be erased and reused, and displays good conventional photoconductivity.

EXAMPLE 3

This example illustrates the use of a master made from the film of Example 2 to prepare high quality color images.

Halftone color prints (1800 dpi, 150 lpi) were made by imagewise exposing a film prepared according to Example 2 on the above-described breadboard. Three masters were imaged in register, corresponding to cyan, magenta, and yellow separations. Prints were made by registering the masters on a color, electrophotographic linear breadboard. Ground, polyester toners (6 microns in diameter) containing either cyan, magenta, yellow, or black colorants were used to develop the images. The toned images were electrostatically transferred in register to clay-coated paper, and the transferred images were fused in an oven at 120° C. for 20 sec. The image quality of the resulting 150 line screen halftone prints was excellent. After allowing the masters which had been imaged as described above to sit in the dark for 2 days, it was found that another high quality color image could be developed, transferred to clay-coated paper, and fused, with no noticeable loss of image quality. Thus, the electrostatic latent image exhibits excellent stability.

Although the invention has been described in detail for the purpose of illustration, it is understood that such detail is solely for that purpose, and variations can be made therein by those skilled in the art without departing from the spirit and scope of the invention which is defined by the following claims.

We claim:

1. A photoelectrographic element for electrostatic imaging comprising a conductive layer in electrical contact with an acid photogenerating layer which is free of photopolymerizable materials and comprises an electrically insulating binder and an acid photogenerator, wherein the improvement comprises:

a phthalocyanine pigment, thereby making said photoelectrographic element capable of being imaged with near-infrared radiation.

2. A photoelectrographic element according to claim 1, wherein the acid photogenerator is selected from the group consisting of 6-substituted-2,4-bis(trichloromethyl)-5-triazines, aromatic onium salts containing elements selected from the group consisting of Group Va, Group VIa, and Group VIIa elements, and diazonium salts.

3. A photoelectrographic element according to claim 2, wherein the acid photogenerator is an aromatic onium salt selected from the group consisting of aryl halonium salts, aryl phosphonium salts, aryl arsenonium salts, aryl sulfonium salts, triaryl selenonium salts, aryl diazonium salts, and mixtures thereof.

4. A photoelectrographic element according to claim 3, wherein the acid photogenerator is di-(4-t-butylphenyl iodonium trifluoromethanesulfonate).

5. A photoelectrographic element according to claim 1, wherein the binder is selected from the group consisting of polycarbonates, polyesters, polyolefins, phenolic resins, paraffins, and mineral waxes.

6. A photoelectrographic element according to claim 1, wherein the binder is an aromatic ester of a polyvinyl alcohol polymer.

7. A photoelectrographic element according to claim 1, wherein the acid photogenerating layer contains at least one weight percent of the acid photogenerator.

8. A photoelectrographic element according to claim 1, wherein the pigment is in the acid photogenerating layer.

9. A photoelectrographic element according to claim 1, wherein the pigment is in a layer separate from the acid photogenerating layer.

10. A photoelectrographic element according to claim 1, wherein the pigment is a metal phthalocyanine pigment.

11. A photoelectrographic element according to claim 10, wherein the pigment is selected from the group consisting of bromoindium phthalocyanine. titanyl phthalocyanine, and tetrafluorophthalocyanine.

12. A photoelectrographic element according to claim 1, wherein the acid photogenerating layer further comprises:

a copper (II) salt and a compound containing secondary hydroxyl groups.

13. A photoelectrographic element according to claim 12, wherein the copper (II) salt is selected from the group consisting of copper (II) arylates, copper (II) alkanoates, copper (II) acetonates, copper (II) acetoacetates, and mixtures thereof.

14. A photoelectrographic element according to claim 13, wherein the copper (II) salt is copper (II) ethyl acetoacetate and the compound containing secondary hydroxyl groups has the formula:

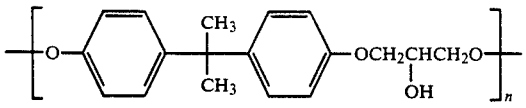

15. A photoelectrographic element according to claim 14, where the phthalocyanine pigment absorbs near-ultraviolet radiation, whereby making said photoelectrographic element capable of being imaged with either near-infrared radiation or near-ultraviolet radiation.

16. A photoelectrographic element for electrostatic imaging comprising a conductive layer in electrical contact with an acid photogenerating layer which is free of photopolymerizable materials and comprises:

an acid photogenerator which is an aromatic onium salt selected from the group consisting of aryl halonium salts, aryl phosphonium salts, aryl arsenonium salts, aryl sulfonium salts, triaryl selenonium salts, aryl diazonium salts, and mixtures thereof;

an electrically insulating binder selected from the group consisting of polycarbonates, polyesters, polyolefins, phenolic resins, paraffins, and mineral waxes;

a phthalocyanine pigment, thereby making said photoelectrographic element capable of being imaged with near-infrared radiation;

a copper (II) salt; and a compound containing secondary hydroxyl groups.

* * * * *